343-700 MS AU 254 EX
11/15/83 OR 4,415,900

United States Patent [19]
Kaloi

[11] 4,415,900
[45] Nov. 15, 1983

[54] CAVITY/MICROSTRIP MULTI-MODE ANTENNA

[75] Inventor: Cyril M. Kaloi, Thousand Oaks, Calif.

[73] Assignee: The United States of America as represented by the Secretary of the Navy, Washington, D.C.

[21] Appl. No.: 335,308

[22] Filed: Dec. 28, 1981

[51] Int. Cl.[3] ..... H01Q 1/38
[52] U.S. Cl. ..... 343/700 MS
[58] Field of Search ..... 343/700 MS, 708, 769, 343/846, 854, 853

[56] References Cited

U.S. PATENT DOCUMENTS

| | | | |
|---|---|---|---|
| 3,978,487 | 8/1976 | Kaloi | 343/700 MS |
| 4,063,246 | 12/1977 | Greiser | 343/846 |
| 4,138,684 | 2/1979 | Kerr | 343/700 MS |
| 4,287,518 | 9/1981 | Ellis, Jr. | 343/700 MS |

*Primary Examiner*—Eli Lieberman
*Attorney, Agent, or Firm*—Robert F. Beers; Joseph M. St.Amand

[57] ABSTRACT

A microstrip backfire antenna configuration combining the microstrip type antenna element with a waveguide cavity which provides control over the radiation pattern and obviates the need for a more expensive phased array antenna system; the microstrip element is placed in a waveguide cavity so as to excite both the microstrip element and the waveguide cavity in a predetermined manner.

17 Claims, 14 Drawing Figures

CAVITY/MICROSTRIP MULTI-MODE ANTENNA

BACKGROUND OF THE INVENTION

This invention relates to microstrip antennas and more particularly to a multi-mode antenna using both microstrip antenna elements and a waveguide cavity.

Compact missile-borne antenna systems require complex antenna beam shapes. At times, these beam shapes are too complex to obtain with a single antenna type such as slots, monopoles, microstrip, etc., and require a more expensive phased array.

Studies indicate that a less expensive approach can be realized in a multi-mode antenna. A multi-mode antenna is a design technique that incorporates two or more antenna types into one single antenna configuration, and uses the unique radiation pattern of each antenna type to provide a combined desired radiation pattern. This requires techniques for exciting two or more antenna modes with one single input feed and also for controlling the excitation of the mode of each antenna type in order to better shape the pattern.

SUMMARY OF THE INVENTION

A multi-mode antenna configuration combines the microstrip type antenna element with a waveguide cavity. This new combination, depending on the various antenna parameters, can provide control over the radiation pattern and thereby obviates the need for a more expensive phased array antenna system. The cavity/microstrip multi-mode antenna of this invention consists of placing the microstrip elememt in a waveguide cavity so as to excite both the microstrip element and the waveguide cavity in a predetermined manner. This antenna may use a combination of an open waveguide with a microstrip element, one or more waveguide slots with a microstrip element, two or more microstrip elements with an open waveguide, or any combinations of the above.

DESCRIPTION AND OPERATION

While a rigorous theory for designing the cavity/microstrip multi-mode antenna has not been completed, experimental studies have provided an insight into the effects of the more important parameters and have allowed judicious selection of these parameter values in designing cavity/microstrip multi-mode antennas.

These parameters are waveguide cavity dimensions, microstrip element dimensions, antenna bandwidth, antenna excitation or feed system, antenna efficiency, and antenna input impedance. It should be understood that no attempt is made here to provide design equations for the microstrip element or the waveguide cavity, since sufficient information now exists in the open literature; instead only the affects of waveguide cavity loading on the microstrip element when combined together is discussed herein.

Figure 1A:
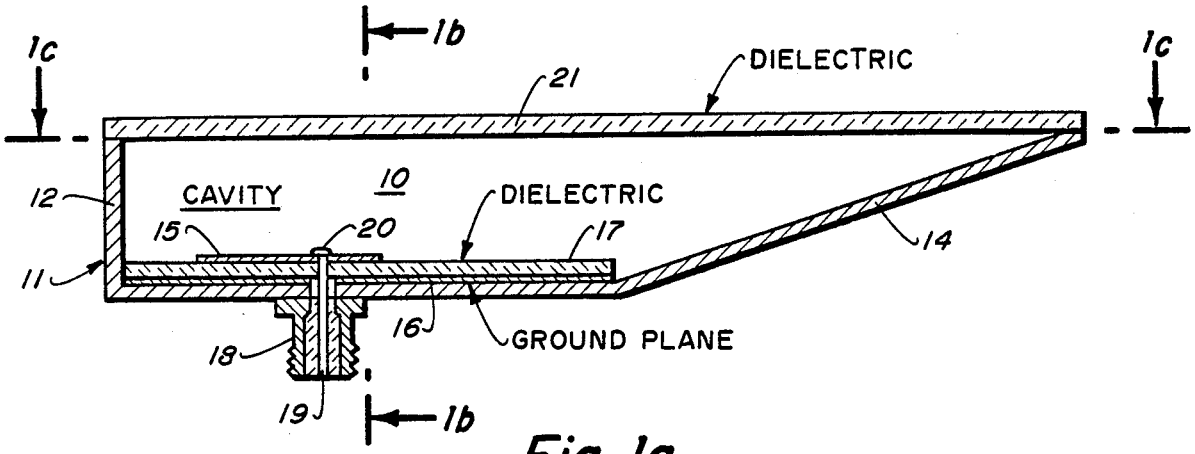
FIG. 1*a* is a cross-sectional longitudinal view of a cavity/microstrip multi-mode antenna taken along line 1*a*—1*a* of FIG. 1*c*.
Figure 1B:
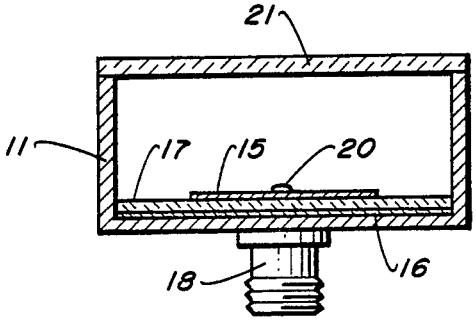
FIG. 1*b* is a cross-sectional view taken along line 1*b*—1*b* of FIG. 1*a*.
Figure 1C:
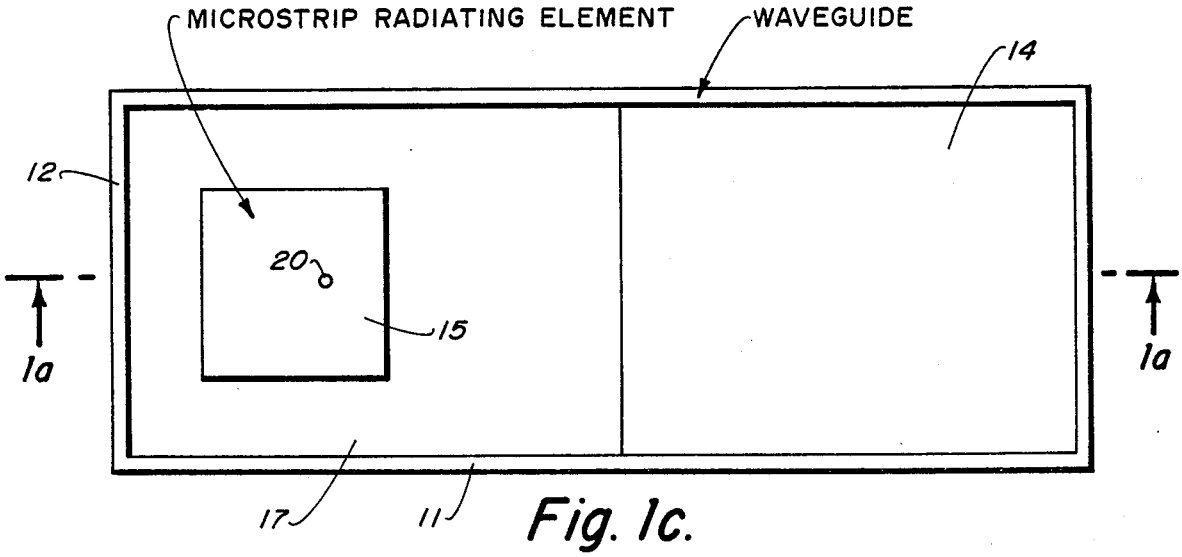
FIG. 1*c* is a cross-sectional planar view taken along line 1*c*—1*c* of FIG. 1*a*.

Referring now to the drawings like numerals refer to like parts in each of the figures. FIGS. 1*a*, 1*b* and 1*c* show a typical cavity/microstrip multi-mode antenna of the present invention, having a combination of both a microstrip antenna element and an open waveguide cavity. The antenna comprises an open waveguide cavity 10 formed in a section of waveguide 11. One end of waveguide section 11 is closed with a normal square end closure 12. The forward end of the waveguide cavity is closed with a ramp formation 14 which acts as a device for aiding propagation of the radiating wave in a forward direction, i.e., reduces reflection from an abrupt continuity due to a square end closure. A microstrip antenna element 15 is formed on and separated from a ground plane 16 by a dielectric substrate 17. Ground plane 16 is in contact with the bottom of waveguide cavity 10. The bottom of cavity 10 can operate as the ground plane for microstrip antenna element 15, but for accuracy and ease in construction the manufacture of element 15 together with ground plane 16 by printed circuit board techniques is more convenient. Element 15 is fed from a coaxial-to-microstrip adapter 18 with the center pin 19 of the adapter extending to the feedpoint 20 of the element. When excited microstrip element 15 in turn excites the waveguide cavity 11. The dielectric cover 21 in this case is electrically nonfunctioning and provides a protective covering for the antenna system.

Figure 2A:
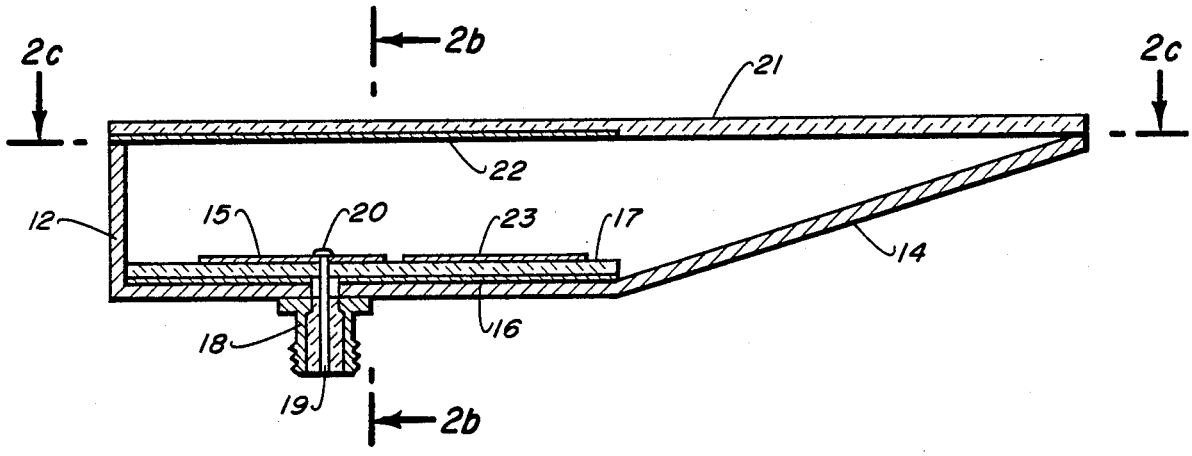
FIG. 2*a* is a cross-sectional longitudinal view, taken along line 2*a*—2*a* of FIG. 2*c*, of a cavity/microstrip multi-mode antenna similar to that of FIG. 1*a*, except for an upper ground plane that covers part of the open cavity and a parasitically fed microstrip radiating element.
Figure 2B:
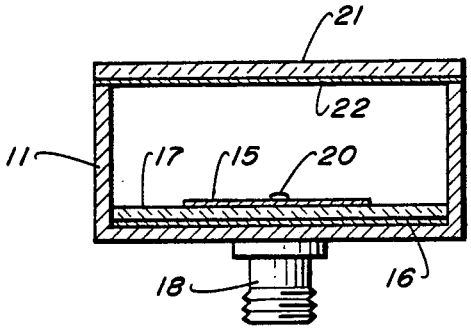
FIG. 2*b* is a cross-sectional view taken along line 2*b*—2*b* of FIG. 2*a*.
Figure 2C:
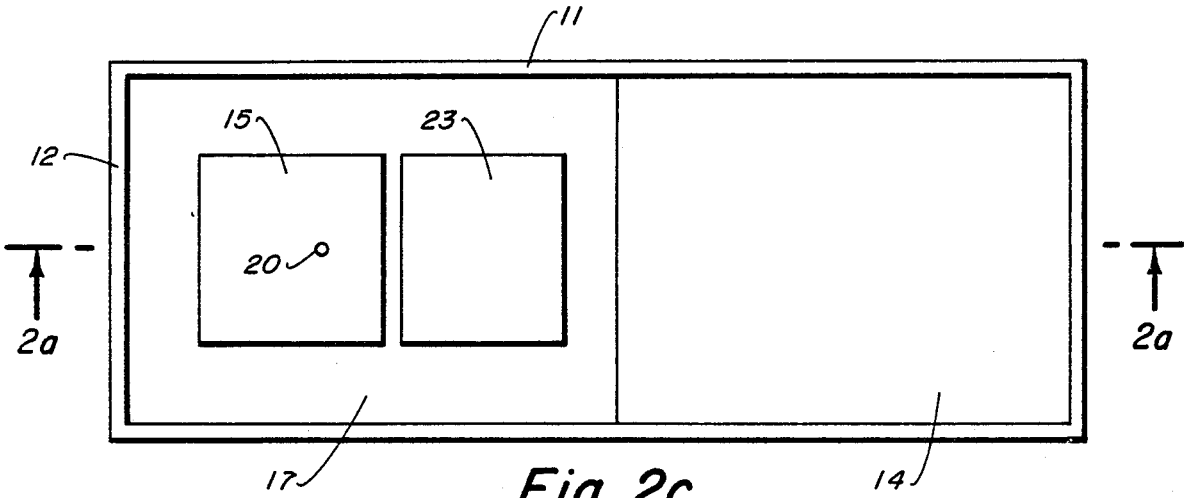
FIG. 2*c* is a cross-sectional planar view taken along line 2*c*—2*c* of FIG. 2*a*.

The antenna shown in FIGS. 2*a*, 2*b* and 2*c* is similar to that of FIGS. 1*a*, 1*b* and 1*c* except that the open part of the cavity is partially covered with an upper ground plane 22 as shown in FIGS. 2*a* and 2*b* and the microstrip antenna, by way of example, consists of parasitically fed element 23 in addition to directly fed element 15. The microstrip radiating element 15 is likewise fed from a coaxial-to-microstrip adapter 18 with the center pin 19 of the adapter extending to the feedpoint 20 of element 15. Microstrip element 15 in turn parasitically excites element 23, and both radiating elements 15 and 23 excite the waveguide cavity 11.

The amount of excitation imparted to the cavity is governed by the height of the cavity and the size of the opening above cavity 11. The upper ground plane 21 is used to determine the amount of opening above cavity 11. The deeper the cavity 11, the more excitation is imparted to the cavity, and conversely. Also, increasing the length of the upper ground plane 21 increases the excitation of the cavity, and conversely.

Figure 3:
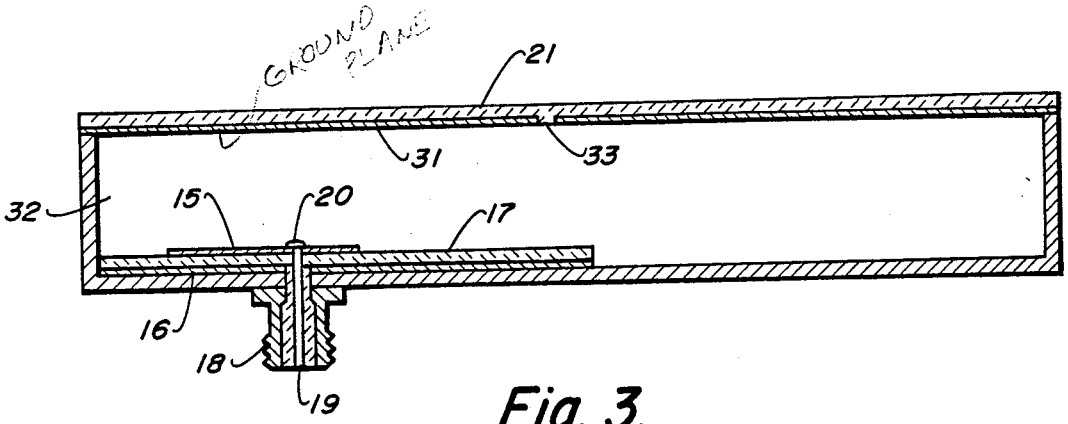
FIG. 3 is a cross-sectional longitudinal view of a cavity/microstrip multi-mode antenna with a single slot in the upper ground plane which covers the cavity.
Figure 4:
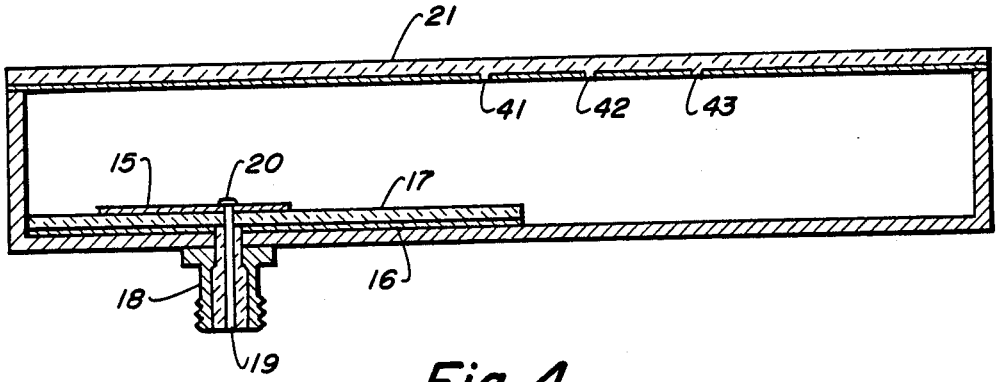
FIG. 4 shows an antenna as in FIG. 3, but with a plurality of slots in the upper ground plane that covers the cavity.

If the length of an upper ground plane, such as ground plane 31 in FIG. 3, is increased from both ends to where the opening in the cavity 32 approaches a thin slot 33, the antenna will radiate with all the characteristics of a thin slot radiator. Conversely, if the cavity depth is allowed to approach zero and the upper ground plane completely removed, the antenna system will radiate with all the characteristics of a microstrip antenna. A plurality of slots can be used in the upper ground plane, if desired, such as slots 41, 42 and 43 in upper ground plane 45, shown in FIG. 4, by way of example. In the case of a slot radiator, as in FIGS. 3 and 4, the ramp for directing the wave is omitted and regular square end closures are used at both ends of the waveguide section.

Figure 5:
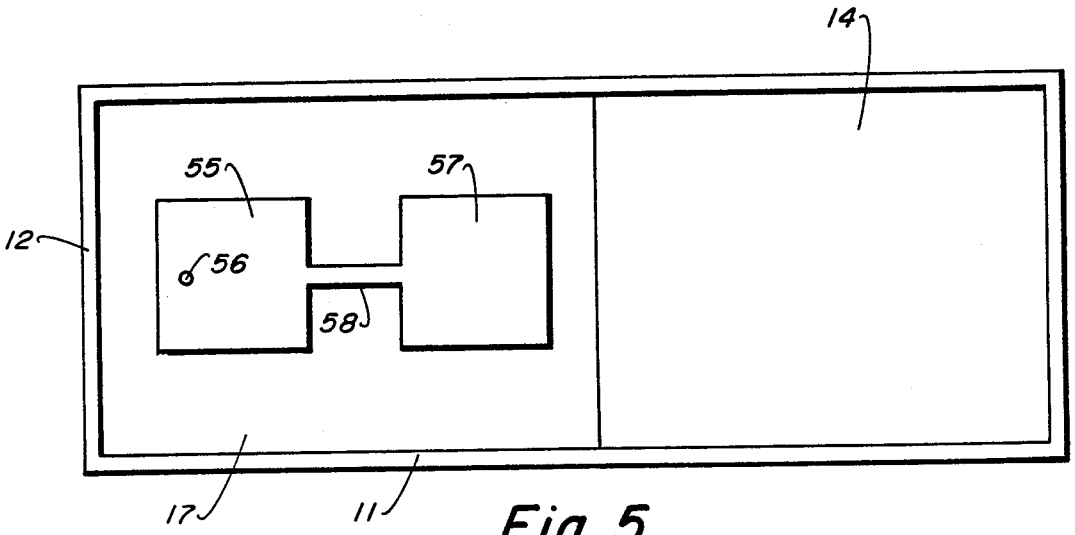
FIG. 5 is a planar view as in FIG. 1*c*, but with two microstrip elements, fed from a single feedpoint, the second element connected to the first by microstrip transmission line.
Figure 6:
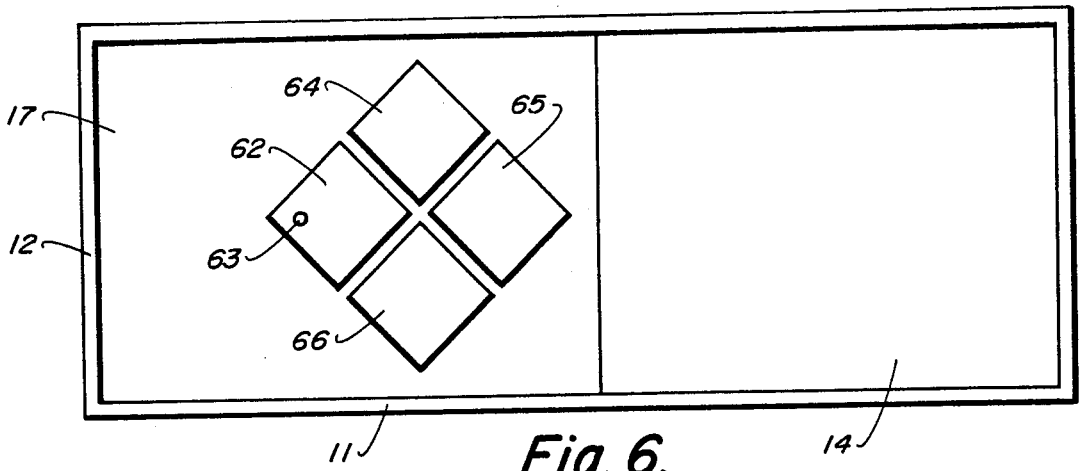
FIG. 6 is another planar view as in FIG. 1*c*, but with multi-parasitic fed microstrip antenna elements.

FIGS. 1, 1*b* and 1*c* show an antenna system being fed with a square asymmetrically fed microstrip element 15. This type of microstrip element is disclosed in U.S. Pat. No. 3,972,049. Arrays of the square asymmetrically fed elements may also be used. Other types and shapes of the microstrip radiating elements, such as shown in FIGS. 2*c*, 5 and 6 for example, can be used. In FIG. 5 is shown an antenna similar to that of FIGS. 1*a*, 1*b* and 1*c*; however, in this antenna an asymmetrically fed microstrip element 55 is fed at feedpoint 56 from beneath by a coaxial connector, as in FIGS. 1*a* and 1*b*, and a second microstrip element 57 is fed from microstrip element 55 via microstrip transmission line 58. The antenna shown in FIG. 6 is, likewise, similar to that of FIGS, 2*a*, 2*b* and 2*c*; however, in this antenna, a diagonally fed element 62, is fed at its feedpoint 63 from beneath by a coaxial connector, as in FIGS. 2*a* and 2*b*, and microstrip elements 64, 65 and 66 are fed parasitically from element 62. Both electric and magnetic microstrip radiating elements, such as disclosed in U.S. Pat. Nos. 3,947,850; 3,972,049; 3,978,488; 3,984,834; 4,040,060; 4,051,478; 4,067,016; 4,078,237; 4,059,227; 4,117,489; and 4,125,839, for example, can be used to give various radiation and polarizations (linear and circular). Although other parameters such as substrate thickness, cavity dimensions, etc., may affect the radiation pattern of the antenna system, maximum control for imparting excitation to the cavity depth and upper ground plane length.

Figure 7:
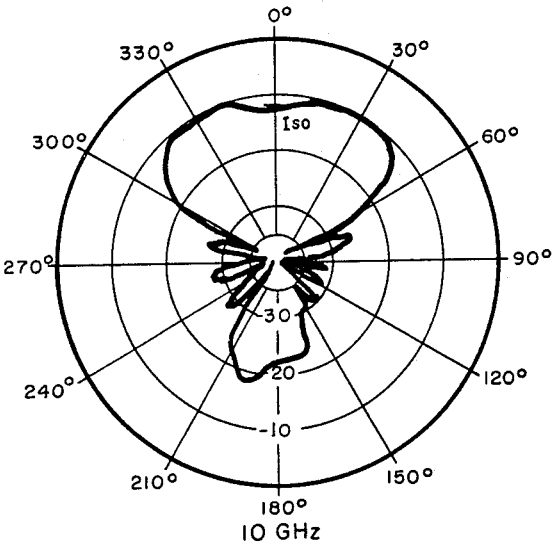
FIG. 7 shows an azimuthal (yaw plane) antenna radiation pattern for a typical eight element waveguide slot array.
Figure 8:
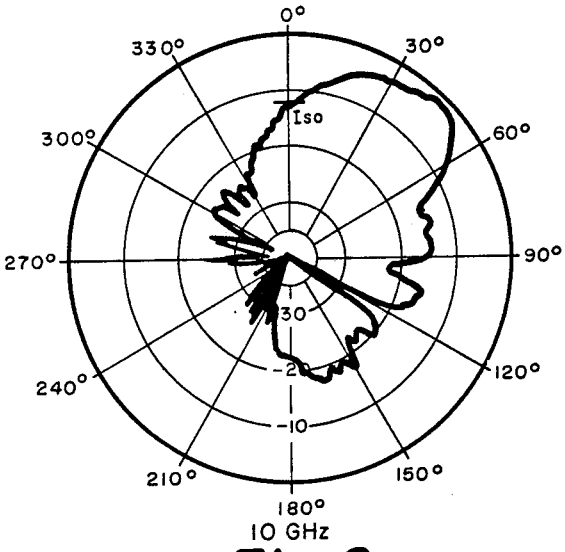
FIG. 8 shows an elevation (pitch plane) antenna radiation pattern for a typical eight element waveguide slot array.
Figure 9:
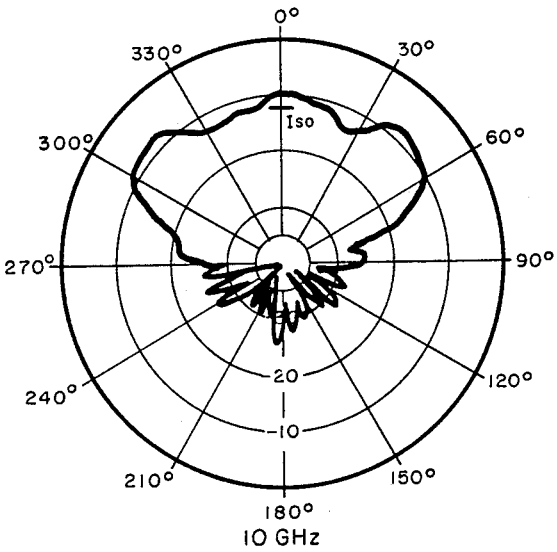
FIG. 9 shows an azimuthal (yaw plane) antenna radiation pattern for a cavity/microstrip multi-mode antenna as shown in FIG. 1.
Figure 10:
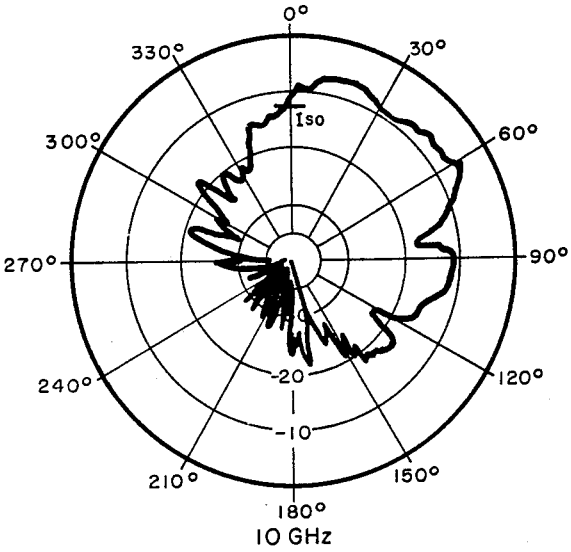
FIG. 10 shows an elevation (pitch plane) antenna radiation pattern for a cavity/microstrip multi-mode antenna as shown in FIG. 1.

Radiation patterns for a typical eight element waveguide slot array are shown in FIGS. 7 and 8 for the yaw plane and pitch plane, respectively. In comparison with the radiation patterns for a waveguide slot array are radiation patterns for a cavity/microstrip multi-mode antenna of this invention, as shown in FIGS. 9 and 10, showing improvements in the shape of the radiation patterns.

The resonant frequency is predominately determined by the microstrip antenna resonant frequency. As more excitation is imparted to the cavity, the cavity tends to reactively load the microstrip antenna, and the reactive affects must be included to determine the antenna systems' resonant frequency. As mentioned earlier there are no design equations for this type antenna, therefore, one would normally design the microstrip antenna using techniques mentioned in the aforementioned U.S. patents (for example, U.S. Pat. No. 3,972,049 for the asymmetrically fed microstrip antenna) and experimentally match the effects of reactive load due to the cavity by lengthening or shortening the microstrip antenna element. The bandwidth of the antenna system is predominately determined by the microstrip antenna element, and bandwidth calculations information may be obtained from the aforementioned U.S. patents. The cavity loading will have minimal effect on the bandwidth.

The input impedance of the microstrip/cavity antenna system is governed by how much excitation is imparted to the cavity. Having more excitation imparted to the cavity causes more reactive loading on the microstrip antenna element. The technique for obtaining optimum impedance match is to first design the microstrip element using design equations in the aforementioned U.S. patents. The next step is to experimentally determine the amount of reactive loading due to the cavity, and compensate for the reaction loading by lengthening or shortening the microstrip element and also relocating the feedpoint of the microstrip element (in the case of the asymmetrically fed element the feedpoint if varied along the length of the element).

As mentioned earlier, the cavity dimension is governed by the desired amount of excitation imparted to the cavity, and also the cavity mode desired. Design information for obtaining designs of various cavity excitation modes can be found in a variety of texts.

Experimental results show that multi-mode techniques provide some control over the radiation pattern of singularly fed antenna elements. It has been found that this concept is especially adaptable to the microstrip antenna element.

Obviously many modifications and variations of the present invention are possible in the light of the above teachings. It is therefore to be understood that within the scope of the appended claims the invention may be practiced otherwise than as specifically described.

What is claimed is:

1. A waveguide cavity and microstrip multi-mode antenna system for providing control over and for producing complex and improved radiation patterns, comprising:

a. a section of rectangular waveguide being closed at each end and having an opening in one broad surface thereof to form a cavity therein;

b. a microstrip radiating element being formed above a ground plane at the bottom of said waveguide cavity; said microstrip radiating element being spaced from said ground plane by a dielectric substrate;

c. said microstrip radiating element being fed from a single coaxial-to-microstrip adapter the center pin of which passes through the bottom of said waveguide to the radiating element feedpoint;

d. said microstrip radiating element being excited by microwave energy via said coaxial-to-microstrip adapter and in turn said microstrip radiating element exciting said waveguide cavity in a predetermined manner;

e. the forward end of said waveguide cavity being closed with a ramp formation which acts to aid propagation of radiating waves in a forward direction, thereby reducing reflection from an abrupt continuity due to a square end closure.

2. A multi-mode antenna system as in claim 1 wherein a dielectric cover which is electrically nonfunctioning is provided as a protective covering for the antenna system.

3. A multi-mode antenna system as in claim 1 wherein the dimensions of said upper ground plane is used to determine the size of the opening above said waveguide cavity.

4. A multi-mode antenna system as in claim 1 wherein the upper ground plane is dimensioned to provide only a thin slot allowing said antenna system to radiate with all the characteristics of a thin slot radiator.

5. A multi-mode antenna system as in claim 1 wherein said upper ground plane is dimensioned to provide a plurality of slots therein.

6. A multi-mode antenna system as in claims 4 or 5 wherein square end closures are used at each end of said waveguide cavity.

7. A multi-mode antenna system as in claim 1 wherein maximum control for imparting excitation to said waveguide cavity is by varying the cavity depth and upper-ground plane length.

8. A waveguide cavity and microstrip multi-mode antenna system for providing control over and for producing complex and improved radiation patterns, comprising:

a. a section of rectangular waveguide being closed at each end and having an opening in one broad surface thereof to form a cavity therein;

b. a microstrip radiating element being formed above a lower ground plane at the bottom of said waveguide cavity; and microstrip radiating element being spaced from said lower ground plane by a dielectic substrate;

c. said microstrip radiating element being fed from a single coaxial-to-microstrip adapter the center pin of which passes through the bottom of said waveguide to the radiating element feedpoint;

d. said microstrip radiating element being excited by microwave energy via said coaxial-to-microstrip adapter and in turn said microstrip radiating element exciting said waveguide cavity in a predetermined manner; and e. said opening in one broad surface of said section of rectangular waveguide being partially covered with an upper ground plane.

9. A multi-mode antenna system as in claim 8 wherein the forward end of said waveguide cavity is closed with a ramp formation which acts to aid propagation of radiating waves in a forward direction, thereby reducing reflection from an abrupt continuity due to a square end closure.

10. A multi-mode antenna system as in claim 1 or 8 wherein the amount of excitation imparted to said waveguide cavity is governed by the height of the cavity and the size of the opening above the cavity.

11. A multi-mode antenna system as in claims 1 or 8 wherein one or more microstrip radiating elements are formed above said ground plane at the bottom of said waveguide cavity and fed from a single feed.

12. A multi-mode antenna system as in claims 8 or 7 wherein resonant frequency is predominately determined by the microstrip radiating element resonant frequency; as excitation is imparted to the waveguide cavity, the cavity tends to reactively load the microstrip radiating element and the reactive effects in turn are included to determine the antenna systems' resonant frequency.

13. A multi-mode antenna system as in claim 8 wherein maximum control for imparting excitation to said waveguide cavity is by varying the cavity depth and upper-ground plane length.

14. A multi-mode antenna system as in claim 8 wherein the dimensions of said upper-ground plane is used to determine the size of the opening above said waveguide cavity.

15. A multi-mode antenna system as in claim 8 wherein the upper-ground plane is dimensioned to provide only a thin slot allowing said antenna system to radiate with all the characteristics of a thin slot radiator.

16. A multi-mode antenna system as in claim 8 wherein said upper-ground plane is dimensioned to provide a plurality of slots therein.

17. A multi-mode antenna system as in claim 8 wherein a dielectric cover which is electrically nonfunctioning is provided as a protective covering for the antenna system.

* * * * *